US011186097B2

(12) United States Patent
Ojima et al.

(10) Patent No.: US 11,186,097 B2
(45) Date of Patent: Nov. 30, 2021

(54) PRINTING APPARATUS

(71) Applicant: SHOWA ALUMINUM CAN CORPORATION, Tokyo (JP)

(72) Inventors: Shinichi Ojima, Tokyo (JP); Kazunori Ikeda, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 0 days.

(21) Appl. No.: 16/762,136

(22) PCT Filed: Sep. 6, 2018

(86) PCT No.: PCT/JP2018/032976
§ 371 (c)(1),
(2) Date: May 6, 2020

(87) PCT Pub. No.: WO2019/130667
PCT Pub. Date: Jul. 4, 2019

(65) Prior Publication Data

US 2020/0262214 A1 Aug. 20, 2020

(30) Foreign Application Priority Data

Dec. 27, 2017 (JP) ..... JP2017-252473

(51) Int. Cl.
*B41J 3/407* (2006.01)

(52) U.S. Cl.
CPC ..... *B41J 3/4073* (2013.01)

(58) Field of Classification Search
None
See application file for complete search history.

(56) References Cited

U.S. PATENT DOCUMENTS

| | | | |
|---|---|---|---|
| 2005/0081725 | A1 | 4/2005 | Gelbart |
| 2005/0115431 | A1 | 6/2005 | Gelbart |
| 2008/0282913 | A1 | 11/2008 | Noll et al. |
| 2011/0067584 | A1 | 3/2011 | Mueller et al. |
| 2013/0039696 | A1 | 2/2013 | Mori et al. |

(Continued)

FOREIGN PATENT DOCUMENTS

| | | |
|---|---|---|
| CN | 101351340 | 1/2009 |
| CN | 102927143 | 2/2013 |

(Continued)

OTHER PUBLICATIONS

"International Search Report (Form PCT/ISA/210) of PCT/JP2018/032976", dated Nov. 27, 2018, with English translation thereof, pp. 1-4.

(Continued)

*Primary Examiner* — Erica S Lin
(74) *Attorney, Agent, or Firm* — JCIPRNET

(57) ABSTRACT

A printing apparatus is provided with a moving body moving while holding a can body; an image forming unit forming an image on the can body on the moving body stopped at a predetermined stop location; and a pressed part installed at the stop location, at least one of a portion of the moving body stopped at the stop location and a portion of the can body held by the moving body being pressed against the pressed part. Thus, positioning precision of the can body in stopping the can body and performing image formation onto the can body is increased.

10 Claims, 10 Drawing Sheets

(56) References Cited

U.S. PATENT DOCUMENTS

| | | | | |
|---|---|---|---|---|
| 2014/0028771 | A1 | 1/2014 | Yamada et al. | |
| 2015/0059601 | A1 | 3/2015 | Domeier et al. | |
| 2017/0157964 | A1 | 6/2017 | Izume | |
| 2018/0207955 | A1 * | 7/2018 | Ojima | B05C 9/12 |
| 2019/0070866 | A1 | 3/2019 | Kimura et al. | |

FOREIGN PATENT DOCUMENTS

| | | | |
|---|---|---|---|
| CN | 103492272 | 1/2014 | |
| CN | 106660360 | 5/2017 | |
| JP | S6094355 | 5/1985 | |
| JP | H0939366 | 2/1997 | |
| JP | 2012232771 | 11/2012 | |
| JP | 2017071059 | 4/2017 | |
| JP | 2017200752 | 11/2017 | |
| WO | 2016017610 | 2/2016 | |
| WO | WO-2017022402 A1 * | 2/2017 | B05C 5/00 |

OTHER PUBLICATIONS

"Office Action of Japan Counterpart Application" with English translation thereof, dated Sep. 7, 2021, p. 1-p. 19.

* cited by examiner

PRINTING APPARATUS

CROSS-REFERENCE TO RELATED APPLICATION

This application is a 371 application of the international PCT application serial no. PCT/JP2018/032976, filed on Sep. 6, 2018, which claims the priority benefits of Japan application no. 2017-252473, filed on Dec. 27, 2017. The entirety of each of the abovementioned patent applications is hereby incorporated by reference herein and made a part of this specification.

TECHNICAL FIELD

The present invention relates to a printing apparatus.

BACKGROUND ART

In Patent Document 1, there is disclosed a printing device, in which inkjet printing is performed in at least one inkjet printing station, and plural inkjet heads are arranged in the inkjet printing station.

CITATION LIST

Patent Literature

Patent Document 1: Japanese Patent Application Laid-Open Publication No. 2012-232771

SUMMARY OF INVENTION

Technical Problem

In stopping a can body at an installation location of an image forming unit and performing image formation onto the can body, if positioning precision of the can body is poor, an attitude of the can body with respect to the image forming unit lacks stability, and quality of the image to be formed is likely to be degraded.

An object of the present invention is to increase positioning precision of the can body in stopping the can body and performing image formation onto the can body.

Solution to Problem

A printing apparatus to which the present invention is applied includes: a moving body moving while holding a can body; an image forming unit forming an image onto the can body on the moving body stopped at a predetermined stop location; and a pressed part installed at the stop location, at least one of a portion of the moving body stopped at the stop location and a portion of the can body held by the moving body being pressed against the pressed part.

Here, the printing apparatus further includes a biasing unit biasing at least the portion toward a side where the pressed part is provided.

Moreover, the biasing unit biases the portion toward the side where the pressed part is provided by use of a magnetic force.

Moreover, the pressed part rotates and a driving force rotating the can body is transmitted to the moving body via the pressed part and the portion.

Moreover, the pressed part is disposed coaxially with the can body held by the moving body stopped at the stop location.

Moreover, the pressed part is disposed coaxially with the can body, the pressed part also being disposed on an opening side included in the can body.

Moreover, the printing apparatus further includes a positioning unit provided to the stop location, the positioning unit performing positioning of the can body, which is held by the moving body, in a radial direction.

Moreover, the printing apparatus further includes: a rotation body provided to the stop location, the rotation body being disposed coaxially with the can body held by the moving body stopped at the stop location to be used for rotating the can body; and a phase adjustment unit provided to the stop location, the phase adjustment unit adjusting a phase of the can body held by the moving body stopped at the stop location with respect to the rotation body to a predetermined phase.

Moreover, the phase adjustment unit adjusts a phase of the can body with respect to the rotation body to one predetermined phase.

Moreover, the moving body is not provided with a motor used to rotate the can body held by the moving body.

From another standpoint, a printing apparatus to which the present invention is applied includes: a moving body moving while holding a can body; an image forming unit forming an image on the can body on the moving body stopped at a predetermined stop location; and a pressing part installed at the stop location, the pressing part being pressed against at least one of a portion of the moving body stopped at the stop location and a portion of the can body held by the moving body.

Advantageous Effects of Invention

According to the present invention, it is possible to increase positioning precision of the can body in stopping the can body and performing image formation onto the can body.

BRIEF DESCRIPTION OF DRAWINGS

FIG. 9 is a diagram showing another configuration example of the columnar-shaped member and the like.

DESCRIPTION OF EMBODIMENTS

Hereinafter, an exemplary embodiment according to the present invention will be described with reference to attached drawings.

Figure 1:
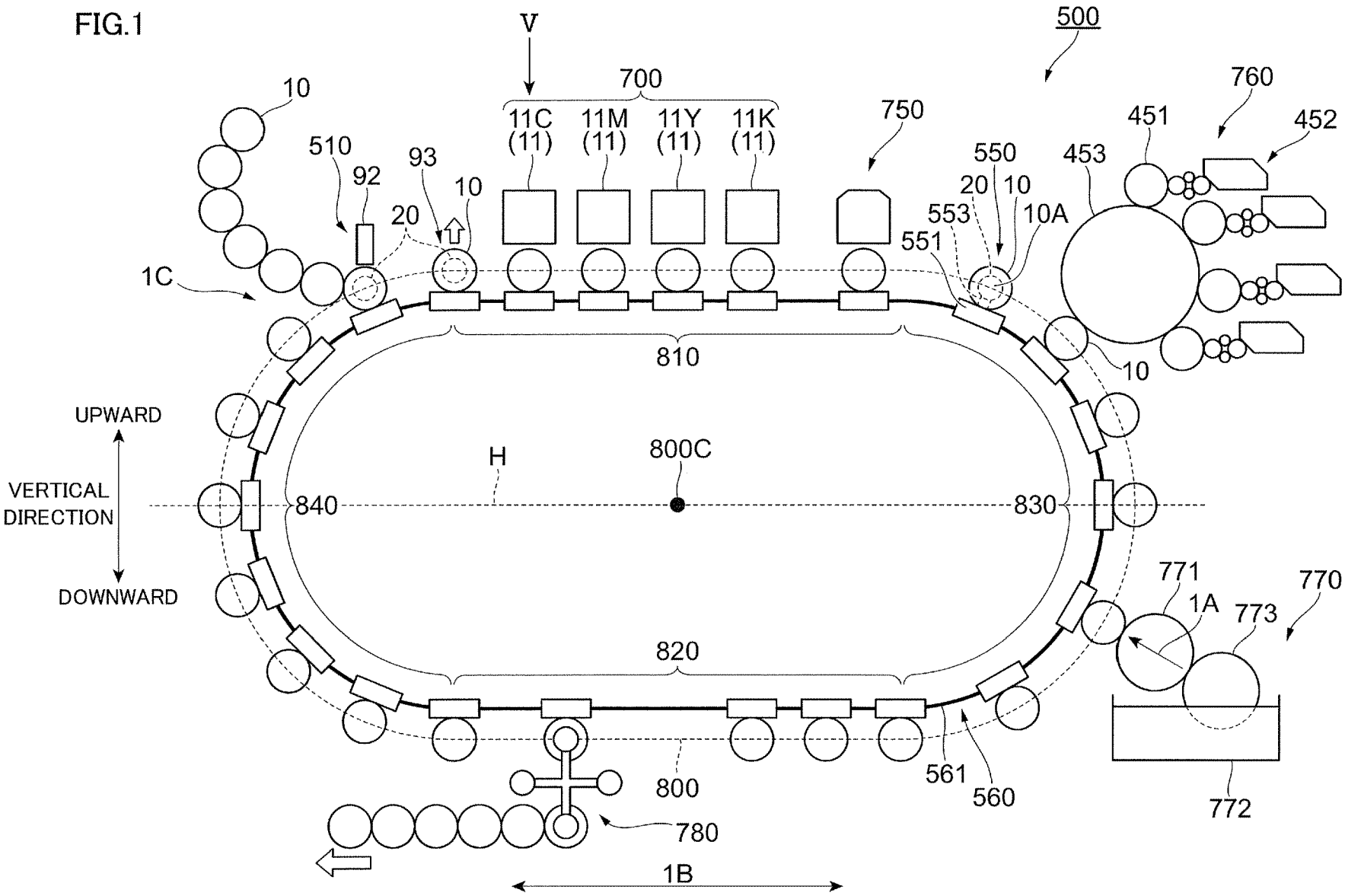
FIG. 1 is a side elevational view of a printing apparatus.

FIG. 1 is a side elevational view of a printing apparatus 500.

The printing apparatus 500 is provided with a can body supply part 510 to which can bodies 10 are supplied. In the can body supply part 510, the can body 10 is supplied (attached) to a support member 20 supporting the can body 10.

Specifically, the support member 20 is formed into a cylindrical shape and the support member 20 is inserted into the cylindrically-shaped can body 10; thereby the can body 10 is supplied to the support member 20.

Further, the can body supply part 510 is provided with an inspection device 92.

The inspection device 92 inspects whether or not the can body 10 is deformed.

Figure 2:
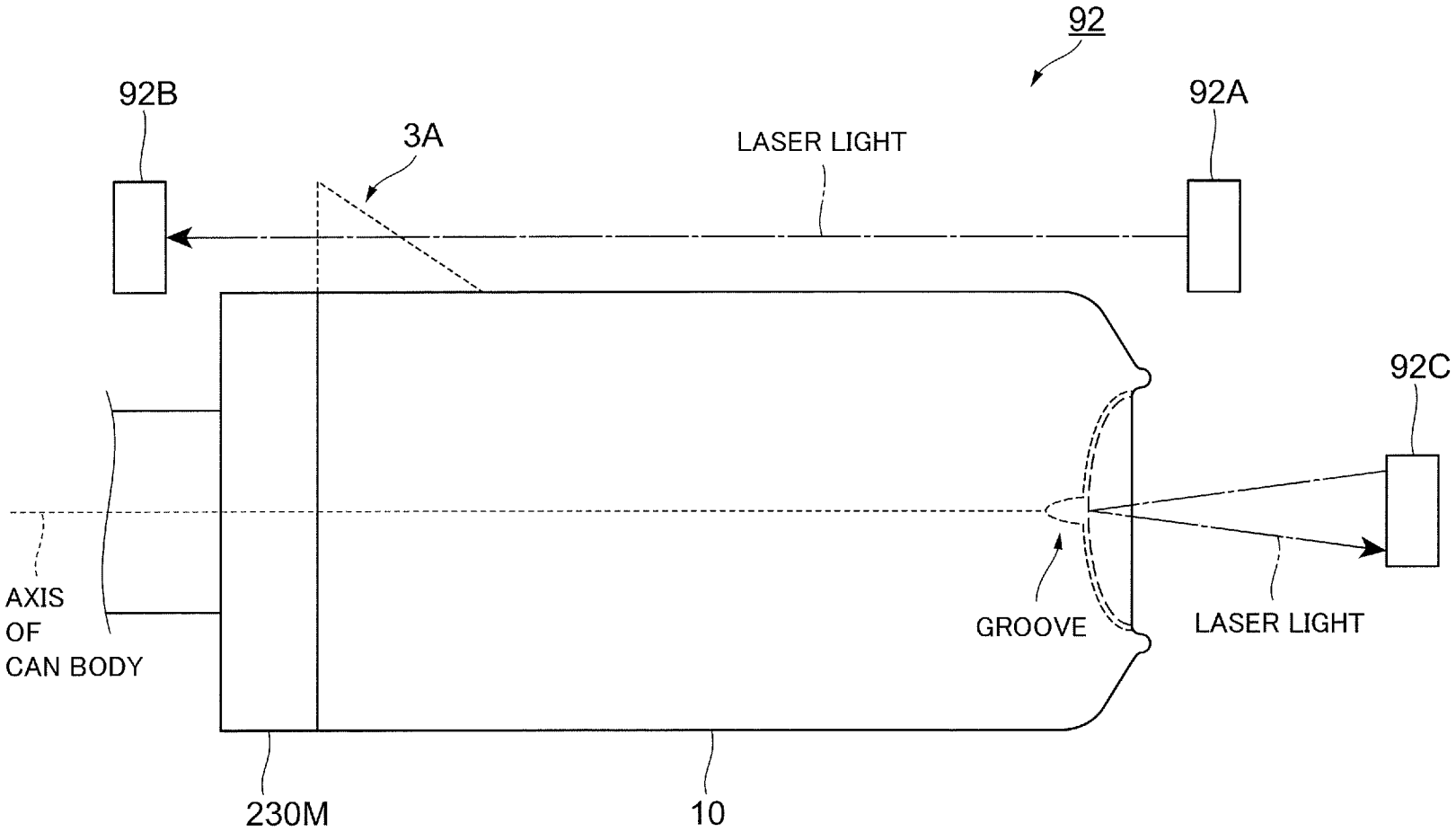
FIG. 2 is a diagram illustrating an inspection device.

More specifically, as shown in FIG. 2 (a diagram illustrating the inspection device 92), the inspection device 92 is provided with a light source 92A.

The light source 92A is provided on one end portion side of the can body 10 and the light source 92A emits laser light that proceeds in an axial direction of the can body 10 along the outer circumferential surface of the can body 10. Further, on the other end portion side of the can body 10, there is provided a light receiving part 92B that receives laser light from the light source 92A.

When a part of the can body 10 is deformed as indicated by the reference sign 3A, the laser light is cut off and the light receiving part 92B cannot receive the laser light. Consequently, deformation of the can body 10 is detected.

Then, in the exemplary embodiment, when it is determined by the inspection device 92 that the can body 10 does not satisfy predetermined conditions (when it is determined that the can body 10 is deformed), a discharge mechanism 93 (refer to FIG. 1) discharges the can body 10 to the outside of the printing apparatus 500.

The discharge mechanism 93 is, as shown in FIG. 1, disposed between the inspection device 92 and an inkjet printing part 700 (disposed on an upstream side of the inkjet printing part 700).

In the exemplary embodiment, before image formation by the inkjet printing part 700 is performed, a deformed can body 10 is discharged from the printing apparatus 500.

In the discharge mechanism 93, compressed air is supplied to the inside of the cylindrically-formed support member 20, to move the can body 10 in the axial direction thereof (in the direction orthogonal to the page of FIG. 1).

Further, the bottom portion (the closed end portion) of the can body 10 is sucked by a not-shown suction member. Then, by the suction member, the can body 10 is conveyed to the outside of the printing apparatus 500; thereby the can body 10 is discharged to the outside of the printing apparatus 500.

On a downstream side of the discharge mechanism 93, the inkjet printing part 700 is provided.

The inkjet printing part 700 forms an image on the can body 10 by use of the inkjet printing method, the can body 10 having moved from the upstream side.

Here, the image formation by the inkjet printing method refers to printing performed by ejecting ink from inkjet heads to attach the ink to the can body 10.

In the image formation by the inkjet printing method, known methods can be used. Specifically, for example, a piezo system, a thermal (bubble) system, a continuous system or the like can be used.

On a downstream side of the inkjet printing part 700, a light irradiation part 750 is provided as an example of a light irradiation unit.

The light irradiation part 750 includes a light source and irradiates the outer circumferential surface of the can body 10, on which image formation by the inkjet printing part 700 has been performed, with light, to thereby cure the image formed on the outer circumferential surface.

In the inkjet printing part 700, the image is formed by use of ultraviolet cure ink. To additionally describe, in the inkjet printing part 700, the image is formed by use of actinic radiation cure ink.

In the light irradiation part 750, the formed image is irradiated with light, such as ultraviolet light. This cures the image formed on the outer circumferential surface of the can body 10.

Here, the inkjet printing part 700 and the light irradiation part 750 are disposed on a lateral side of a first linear part 810 (details thereof will be described later).

Further, in the exemplary embodiment, a plate printing part 760 and a protection layer forming part 770, which are an example of a processing unit, are provided.

In the conveyance direction of the can bodies 10, the plate printing part 760 is disposed on the downstream side of the inkjet printing part 700. In the conveyance direction of the can bodies 10, the protection layer forming part 770 is disposed on the downstream side of the plate printing part 760.

The plate printing part 760 performs image formation onto the can body 10 by use of the plate printing method.

Specifically, the plate printing part 760 is provided with plural plate cylinders 451. On the surface of the plate cylinder 451, a convex portion (not shown) corresponding to an image to be formed by the plate printing is provided. In addition, the plate printing part 760 is provided with plural ink supply units 452 supplying ink to the convex portions of the plate cylinders 451.

Further, the plate printing part 760 is provided with a blanket 453 to which the ink from the plate cylinders 451 is transferred and which transfers the ink to the can body 10.

In the plate printing part 760, the can body 10 stops at a position facing the blanket 453. Further, the can body 10 rotates in the circumferential direction.

Moreover, in the plate printing part 760, ink is supplied from the ink supply units 452 to the surfaces of the respective corresponding plate cylinders 451. Then, the ink adhered to the surfaces of the plate cylinders 451 (the ink adhered to the convex portions of the plate cylinders 451) is transferred to the blanket 453. Further, the ink transferred to the blanket 453 is transferred to the rotating can body 10. Consequently, an image by the plate printing method is formed on the outer circumferential surface of the can body 10.

Here, image formation by the plate printing method refers to image formation by use of plates. More specifically, the image formation by the plate printing method refers to image formation onto the can body 10 performed by attaching ink to the plates and then transferring the ink adhered to the plates to the can body 10.

Note that the transfer may be performed by bringing the plates and the can body 10 into direct contact, or an intermediate transfer body, such as the blanket 453, may be disposed between the plates and the can body 10, to thereby perform the transfer onto the can body 10.

Here, examples of printing by the plate printing method include relief printing, intaglio printing, planographic printing and stencil printing, and any of these may be used in printing by the plate printing method. Note that, in the exemplary embodiment, image formation onto the can body 10 is performed by use of the relief printing.

The protection layer forming part 770 is disposed on the downstream side of the plate printing part 760.

The protection layer forming part 770 forms a transparent layer covering an image formed by the inkjet printing part 700 or an image formed by the plate printing part 760. Consequently, in the exemplary embodiment, a transparent protection layer is formed as the outermost layer of the can body 10.

Here, the protection layer forming part 770 is provided with a contact member 771 formed into a cylindrical shape or a columnar shape, and brought into contact with the outer circumferential surface of the can body 10.

After the can body 10 is supplied to the position facing the contact member 771, the contact member 771 moves toward the can body 10 to be brought into contact with the can body 10. More specifically, as indicated by the arrow 1A in the figure, the contact member 771 moves in the obliquely upward direction to be brought into contact with the can body 10.

Moreover, the protection layer forming part 770 is provided with a paint container part 772 containing paint. Further, the protection layer forming part 770 is provided with a supply member 773 formed into a cylindrical shape or a columnar shape and supplying the paint in the paint container part 772 to the contact member 771.

In the protection layer forming part 770, the can body 10 rotates in the circumferential direction. Moreover, the paint is supplied to the outer circumferential surface of the contact member 771 by the supply member 773. Consequently, in the exemplary embodiment, the paint adheres to an entire region of the outer circumferential surface in the circumferential direction of the can body 10.

On the downstream side of the protection layer forming part 770, a detachment part 780 detaching the can body 10 from the support member 20 is provided. In the exemplary embodiment, the can body 10 is detached from the support member 20 in the detachment part 780 to be discharged to the outside of the printing apparatus 500.

Further, the printing apparatus 500 is provided with plural moving units 550 as an example of moving bodies that move while supporting the can bodies 10.

In the exemplary embodiment, the above-described support member 20 supporting the can body 10 is attached to the moving unit 550, and the can body 10 moves together with the moving unit 550.

Here, the can body 10 is formed into a cylindrical shape and an opening portion is provided to one end thereof. Moreover, the other end of the can body 10 is closed and the other end is provided with a bottom portion 10A. The support member 20 is inserted into the can body 10 from the opening portion.

Further, in the exemplary embodiment, a moving mechanism 560 that functions as a mover unit that moves the moving units 550. The moving mechanism 560 is provided with an annular-shaped guidance member 561 that guides the moving units 550.

Each of the moving units 550 is guided by the guidance member 561 and orbitally moves along a predetermined annular-shaped movement route 800.

With this, in the exemplary embodiment, the support member 20 provided to the moving unit 550 and the can body 10 supported by the support member 20 also move along the predetermined annular-shaped movement route 800.

The movement route 800 is disposed so that the axial center 800C thereof is arranged along the horizontal direction. To put it another way, the movement route 800 is disposed around the axial center 800C along the horizontal direction. Here, the axial center 800C extends in the direction orthogonal to the page in FIG. 1.

In this case, in the exemplary embodiment, the support member 20 and the can body 10 orbitally move around the axial center 800C extending in the direction orthogonal to the page in the figure.

The movement route 800 is provided with the first linear part 810, which is a linear movement route, and a second linear part 820, which is similarly a linear movement route.

Each of the first linear part 810 and the second linear part 820 is disposed to extend along the horizontal direction. Moreover, the first linear part 810 and the second linear part 820 are disposed to be substantially in parallel with each other. Further, in the exemplary embodiment, the first linear part 810 is disposed above the second linear part 820.

Further, the first linear part 810 is provided to an uppermost portion of the annular-shaped movement route 800, whereas the second linear part 820 is provided to a lowermost portion of the annular-shaped movement route 800.

Further, in the exemplary embodiment, the inkjet printing part 700 is provided above the first linear part 810 positioned at the uppermost portion.

Further, the movement route 800 is provided with a first curved part 830 and a second curved part 840, each of which is formed into an arc with a curvature.

The first curved part 830 connects a right end portion of the first linear part 810 in the figure and a right end portion of the second linear part 820 in the figure. In addition, the first curved part 830 is formed to head downward from above.

Moreover, the second curved part 840 connects a left end portion of the first linear part 810 in the figure and a left end portion of the second curved part 820 in the figure. In addition, the second curved part 840 is formed to head upward from below.

In the exemplary embodiment, the plate printing part 760 and the protection layer forming part 770 are provided on a lateral side of the first curved part 830 (a portion of the movement route 800 with a curvature).

To put it another way, the plate printing part 760 and the protection layer forming part 770 are provided on a lateral side of a portion of the movement route 800 heading downward from above.

In the exemplary embodiment, printing by the plate printing method and formation of the protection layer are performed on the can body 10 positioned at the first curved part 830.

Provision of the plate printing part 760 and the protection layer forming part 770 on a lateral side of the first curved part 830 (the portion of the movement route 800 heading downward from above or heading upward from below) makes it possible to downsize the printing apparatus 500.

Specifically, it is possible to downsize the printing apparatus 500 as compared to the case where these are provided above the first linear part 810. More specifically, the size of the printing apparatus 500 in the horizontal direction (the direction indicated by the arrow 1B in FIG. 1) can be reduced.

Here, in the case where the plate printing part 760 and the protection layer forming part 770 are further provided above the first linear part 810, it becomes necessary to extend the first linear part 810 than the state shown in FIG. 1; therefore, the printing apparatus 500 is upsized.

Further, in the exemplary embodiment, the can body supply part 510 is provided to a portion on an upper side of the annular-shaped movement route 800 (a portion positioned at the upper side of the horizontal line H passing the axial center 800C, hereinafter referred to as "upper-side portion").

Moreover, the detachment part 780 is provided to a portion on a lower side of the annular-shaped movement route 800 (a portion positioned at the lower side of the horizontal line H, hereinafter referred to as "lower-side portion").

This makes it possible to reduce the size of the printing apparatus 500 in the horizontal direction (the direction indicated by the arrow 1B in FIG. 1) as compared to the case where both the can body supply part 510 and the detachment part 780 are provided only at one of the upper-side portion and the lower-side portion.

Note that, in the exemplary embodiment, description has been given of the case where the can body supply part 510 was provided to the upper-side portion and the detachment part 780 was provided to the lower-side portion; however, the present invention is not limited thereto, and it may be possible to provide the can body supply part 510 to the lower-side portion and the detachment part 780 to the upper-side portion.

More specifically, for example, in the case where the inkjet printing part 700 is provided to the second linear part 820 or the like, it may be possible to provide the can body supply part 510 to the lower-side portion and the detachment part 780 to the upper-side portion.

Moreover, in the exemplary embodiment, description has been given of the case, as an example, where the plate printing part 760 and the protection layer forming part 770 were provided on the lateral side of the first curved part 830. However, the present invention is not limited thereto, and, for example, it may be possible to provide the plate printing part 760 on the lateral side of the first curved part 830 and to provide the protection layer forming part 770 on the lateral side of the second curved part 840.

Note that, in this case, the detachment part 780 is provided to a portion indicated by the reference sign 1C (on the downstream side of the protection layer forming part 770).

Moreover, as in the exemplary embodiment, provision of the protection layer forming part 770 on the lateral side of the first curved part 830 (the portion of the movement route 800 heading downward from above or heading upward from below) makes it possible to downsize a mechanism for moving the contact member 771.

In the exemplary embodiment, as described above, the contact member 771 is moved to be brought into contact with the can body 10.

In this case, if the contact member 771 exists below the second linear part 820, it becomes necessary to move the contact member 771 straight up. The case leads to upsizing of a driving source, and thereby the moving mechanism moving the contact member 771 is likely to be upsized.

In contrast thereto, as in the exemplary embodiment, provision of the protection layer forming part 770 on the lateral side of the first curved part 830 eliminates the need to move the contact member 771 straight up.

In this case, the driving source or the like can be small, and thereby the moving mechanism moving the contact member 771 can be downsized. Then, the moving mechanism can be downsized, it becomes also possible to downsize the entire printing apparatus 500.

Next, the inkjet printing part 700 will be described.

The inkjet printing part 700 is disposed above the first linear part 810 to perform image formation onto the can body 10 positioned at the first linear part 810.

The inkjet printing part 700 is provided with plural inkjet heads 11 arranged in line in the left and right directions in the figure. The portion where the plural inkjet heads 11 are provided can be grasped as an image forming unit that performs image formation onto the can body 10.

Specifically, the inkjet printing part 700 is provided with a first inkjet head 11C ejecting cyan ink, a second inkjet head 11M ejecting magenta ink, a third inkjet head 11Y ejecting yellow ink and a fourth inkjet head 11K ejecting black ink.

In the following description, when the first inkjet head 11C to the fourth inkjet head 11K are not particularly distinguished, the inkjet heads are simply referred to as "inkjet heads 11."

Here, the four inkjet heads 11, namely, the first inkjet head 11C to the fourth inkjet head 11K perform image formation onto the can body 10 by use of the ultraviolet cure ink. Moreover, in the exemplary embodiment, the can body 10 is moved in a state of being laid (the can body 10 is moved in the state in which the axial direction of the can body 10 extends along the horizontal state), and a part of the outer circumferential surface of the can body 10 faces upward in the vertical direction. In the exemplary embodiment, ink is ejected downwardly from above the outer circumferential surface, to thereby perform image formation onto the outer circumferential surface of the can body 10.

Further, in the exemplary embodiment, the four inkjet heads 11 are arranged in line along the moving direction of the can body 10. Moreover, each of the four inkjet heads 11 is disposed along a direction orthogonal to (intersecting) the moving direction of the can body 10.

In the exemplary embodiment, in a process in which the can body 10 passes through below the four inkjet heads 11, ink is ejected to the can body 10 from above, and thereby an image is formed on the can body 10.

More specifically, in the exemplary embodiment, the moving unit 550 stops at the installation location of each of the plural inkjet heads 11 that have been provided. Then, in each of the inkjet heads 11, ink is ejected onto the can body 10, to thereby form an image onto the can body 10. Note that, when the image formation if performed in each of the inkjet heads 11, the can body 10 rotates in the circumferential direction.

Note that, in the exemplary embodiment, the case in which the four inkjet heads 11 were provided was shown as an example; however, an inkjet head 11 ejecting ink of a special color, such as a corporate color, or an inkjet head 11 for forming a white underlayer may be provided further.

Each of the moving units 550, as an example of a moving body, moves at a predetermined moving speed. Moreover, each of the moving units 550 stops at each of the can body supply part 510, the discharge mechanism 93, below each of the inkjet heads 11, the light irradiation part 750, the plate printing part 760, the protection layer forming part 770 and the detachment part 780.

Moreover, at each of the inkjet heads 11, the light irradiation part 750, the plate printing part 760, the protection layer forming part 770 and the like, the can body 10 on the moving unit 550 rotates in the circumferential direction at the predetermined rotation speed.

In addition, in the printing apparatus 500 of the exemplary embodiment, the moving units 550 of the number larger than the number of can bodies 10 positioned in the printing apparatus 500 are installed. Further, the moving units 550 move around the axial center 800C.

The moving mechanism 560 is provided with an annular-shaped guidance member 561 that guides the moving units 550. Inside the guidance member 561, electromagnets (not shown) are provided.

Further, in the moving unit 550, a permanent magnet (not shown) is installed.

In the exemplary embodiment, a linear-motor mechanism is used to move the moving units 550.

More specifically, the printing apparatus 500 of the exemplary embodiment is provided with a control part (not shown) and energization to the above-described electromagnets is controlled, to thereby generate magnetic fields for moving each of the moving units 550. Note that the control part is composed of a program-controlled CPU (Central Processing Unit) and the like.

As shown in FIG. 1, the moving unit 550 is provided with a pedestal part 551 guided by the guidance member 561. In the pedestal part 551, the permanent magnet (not shown) is installed.

In the exemplary embodiment, a propulsive force occurs in the moving unit 550 by magnetic fields generated by electromagnets provided to the guidance member 561 and the permanent magnet provided to the pedestal part 551 of the moving unit 550, and thereby the moving unit 550 moves along the annular-shaped movement route 800.

Further, the moving unit 550 of the exemplary embodiment is provided with the cylindrical support member 20 supporting the can body 10 and a fixing member 553 for fixing the support member 20 to the pedestal part 551. The fixing member 553 is provided in the shape of standing from the pedestal part 551.

The support member 20 of the exemplary embodiment is formed into the cylindrical shape, and inserted into the can body 10 through the opening portion formed in the can body 10 to support the can body 10. In addition, the support member 20 is disposed in the state of being laid (along the horizontal direction). Consequently, in the exemplary embodiment, the can body 10 is also disposed in the state of being laid.

In the exemplary embodiment, when the can body 10 reaches each of the inkjet heads 11, ink is ejected from each of the inkjet heads 11 to the can body 10 positioned below. Consequently, an image is formed on the outer circumferential surface of the can body 10.

The light irradiation part 750 is disposed on the downstream side of the inkjet printing part 700 and irradiates the can body 10 with the ultraviolet light being an example of light. Consequently, the image formed on the outer circumferential surface of the can body 10 (the image formed by the inkjet printing part 700) is cured.

Note that, when image formation onto the can body 10 is performed, thermosetting ink may also be used; in this case, for example, a heat source, not a light source, is installed at the location where the light irradiation part 750 is provided.

In the exemplary embodiment, the moving unit 550 stops every time the moving unit 550 reaches below each of the inkjet heads 11. In other words, the moving unit 550 stops at each of predetermined stop locations.

Then, in the exemplary embodiment, onto the outer circumferential surface of the can body 10 held by the moving unit 550 stopped at the predetermined stop location, an image is formed by the inkjet heads 11 as an example of the image forming unit.

More specifically, in each of the inkjet heads 11, ejection of ink from the inkjet head 11 is performed in the state in which the support member 20 (the can body 10) rotates in the circumferential direction, to thereby form an image onto the outer circumferential surface of the can body 10.

In the exemplary embodiment, when the support member 20 rotates 360° after ejection of ink is started, ejection of ink is stopped. Consequently, an image is formed on the entire region in the circumferential direction of the outer circumferential surface of the can body 10.

In the exemplary embodiment, as shown in FIG. 1, the support member 20 is disposed along the direction orthogonal to the page of FIG. 1. To put it another way, the support member 20 is disposed to extend along the horizontal direction.

Moreover, the support member 20 is disposed along the direction orthogonal to (intersecting) the moving direction of the moving unit 550.

In this case, as compared to the case in which the support member 20 is disposed along the moving direction of the moving unit 550, it is possible to reduce the length (the length in the direction indicated by the arrow 1B in FIG. 1) or the height of the printing device 500. Moreover, in this case, it is possible to reduce the full length of the movement route 800 on which the moving unit 550 moves.

Moreover, when the support member 20 is disposed along the direction orthogonal to the moving direction of the moving unit 550, as compared to the case in which the support member 20 is disposed along the moving direction of the moving unit 550, it is possible to increase the disposition density of the moving units 550 in the moving direction of the moving unit 550.

Then, in this case, it is possible to increase the number of moving units 550 that can be installed to the printing apparatus 500.

Further, in the exemplary embodiment, on the outside of the movement route 800 in the radial direction, the functional parts, such as the inkjet printing part 700, the light irradiation part 750, the plate printing part 760, the protection layer forming part 770 and the like are installed.

There are some cases of performing maintenance of the functional parts; in such cases, when the functional parts are disposed outside of the movement route 800, maintenance is performed with ease as compared to a case in which the functional parts are disposed inside the movement route 800.

Moreover, in the exemplary embodiment, the inkjet heads 11 are positioned above the can body 10, and the ink is ejected to the can body 10 from above.

In this case, as compared to a case in which the inkjet heads 11 are disposed at the lateral side of the can body 10 or below the can body 10, it is possible to reduce the effect of gravity acting on ink droplets ejected from the inkjet heads 11, to thereby increase accuracy of ink adhesive positions in the can body 10.

Further, in the exemplary embodiment, the inkjet printing part 700 (the plural inkjet heads 11) is provided on the lateral side of (above) the first linear part 810.

Consequently, as compared to the case in which the inkjet printing part 700 (the plural inkjet heads 11) is provided on the lateral side of the curved part (the first curved part 830 or the second curved part 840), quality of the image to be formed on the can body 10 is likely to be improved.

Figure 3:
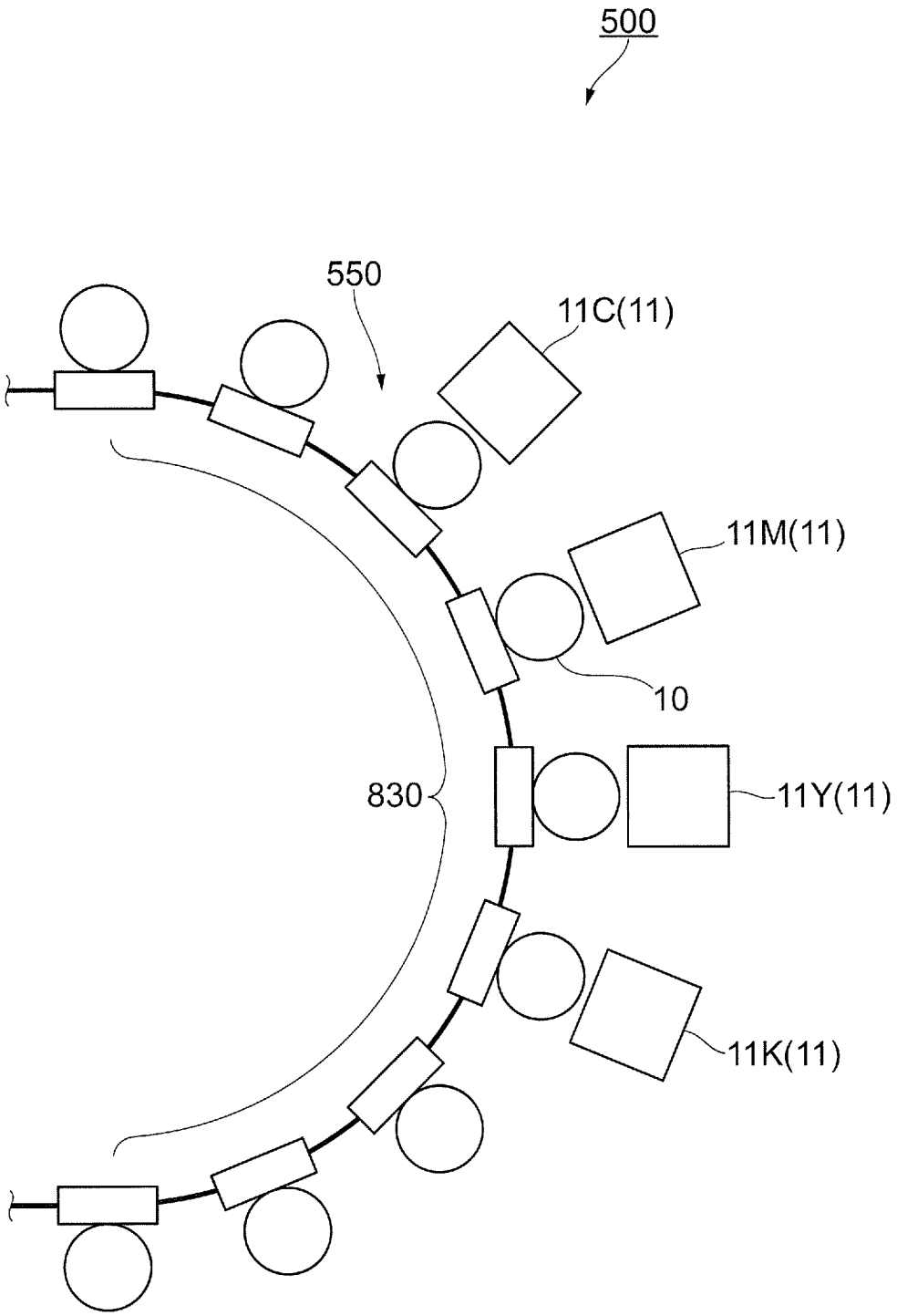
FIG. 3 is a diagram showing Comparative example of the printing apparatus.

Here, in the case where the inkjet heads 11 are provided on the lateral side of the curved part, for example, as shown in FIG. 3 (a diagram showing Comparative example of the printing apparatus 500), the attitudes of the inkjet heads 11 are different in each of the inkjet heads 11.

In this case, as compared to the case where the attitudes of the inkjet heads 11 are the same, the quality of the image to be formed is likely to be degraded due to occurrence of misregistration among images formed by the respective inkjet heads 11.

In contrast thereto, if the inkjet printing part 700 is provided on the lateral side of the linear part (the first linear part 810) as in the exemplary embodiment, the attitudes of the plural inkjet heads 11 are easily aligned, and thereby degradation of quality of the image to be formed can be suppressed.

Figure 4:
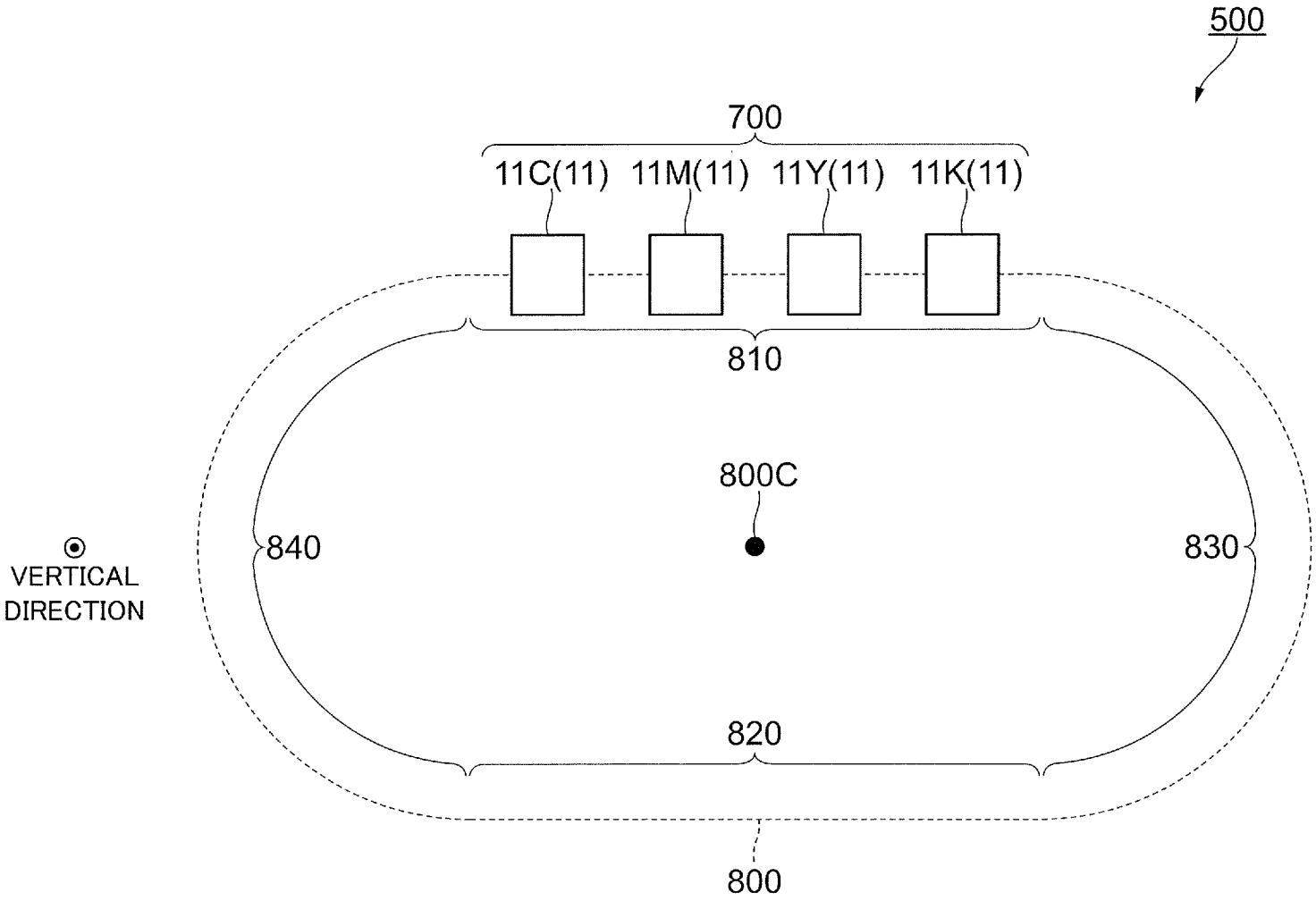
FIG. 4 is a top view showing another configuration example of the printing apparatus.

FIG. 4 is a top view showing another configuration example of the printing apparatus 500.

Note that, in FIG. 4, the inkjet printing part 700 is mainly shown, and illustration of constituents other than the inkjet printing part 700 is considerably omitted.

In the printing apparatus 500, the axial center 800C of the movement route 800 extends along the vertical direction. To put it another way, in the printing apparatus 500, each of the moving units 550 (not shown in FIG. 4) moves along the annular-shaped movement route 800 positioned on a horizontal plane.

Further, in the printing apparatus 500, similar to the above, each of the inkjet heads 11 is provided on the lateral side of (above) the first linear part 810.

In the configuration example, each of the inkjet heads 11 is also provided on the lateral side of the first linear part 810; in this case, similar to the above, the attitudes of the plural inkjet heads 11 are the same, and therefore, it is possible to suppress degradation of quality of the image to be formed.

In FIG. 1, the case in which the axial center 800C of the movement route 800 extended along the horizontal direction was shown as an example; however, as shown in FIG. 4, the printing apparatus 500 may be configured so that the axial center 800C of the movement route 800 extends along the vertical direction.

In this case, also, if the plural inkjet heads 11 are disposed on the lateral side of (above) the linear part, misregistration among images formed by the respective inkjet heads 11 is likely to be suppressed, and thereby degradation of quality of the image to be formed can be suppressed.

Figure 5:
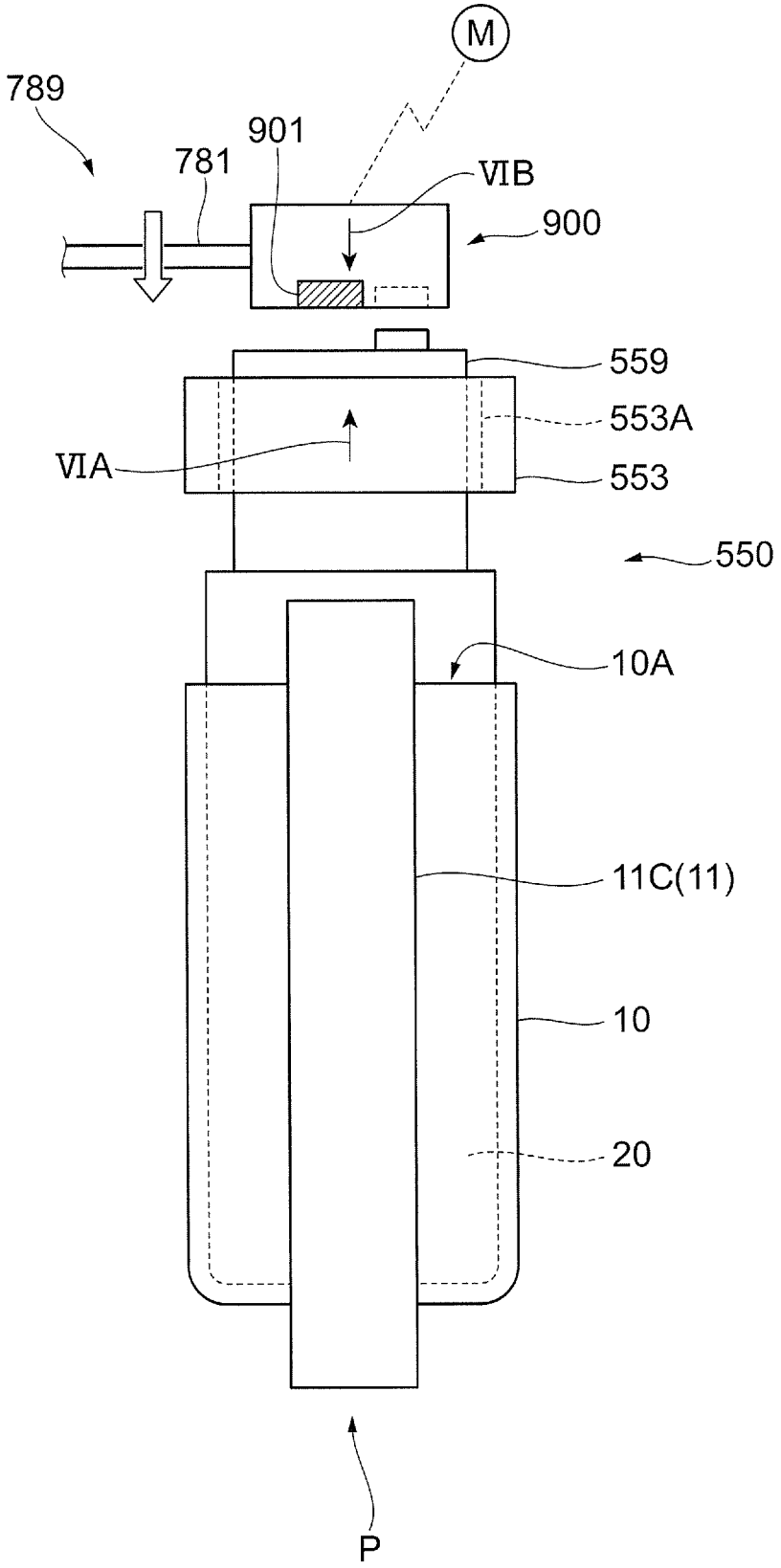
FIG. 5 is a diagram of a case in which an inkjet head and a moving unit are viewed from a direction of an arrow V in FIG. 1.

FIG. 5 is a diagram of a case in which the inkjet head 11C and the moving unit 550 are viewed from the direction of an arrow V in FIG. 1. Note that, in FIG. 5, illustration of the pedestal part 551 (refer to FIG. 1) provided to the moving unit 550 is omitted.

Though illustration was omitted in FIG. 1, in the exemplary embodiment, as shown in FIG. 5, each of the stop locations P, where the moving unit 550 stops, is provided with a pressed part 900 against which a part of the moving unit 550 that has stopped is pressed.

In the pressed part 900, a permanent magnet 901 is installed. Further, each of the stop locations P is provided with a servomotor M that is a driving source to perform rotation control of the pressed part 900 by use of an encoder (not shown). Here, the driving source may be a stepping motor that performs rotation control by the pulse number.

On the other hand, the moving unit 550 is provided with a columnar-shaped member 559 attached to an end portion of the support member 20 that supports the can body 10. The columnar-shaped member 559 is configured with a metal member, and the columnar-shaped member 559 of the exemplary embodiment is attracted by the permanent magnet 901.

In the exemplary embodiment, the columnar-shaped member 559 can move with respect to the fixing member 553, and therefore, the columnar-shaped member 559 can rotate in the circumferential direction. Further, the columnar-shaped member 559 can move in the axial direction of the columnar-shaped member 559.

More specifically, the columnar-shaped member 559 is disposed inside a through hole 553A formed in the fixing member 553 with a gap, and thereby the columnar-shaped member 559 is supported by the fixing member 553 in the state capable of rotating in the circumferential direction and moving in the axial direction.

In the exemplary embodiment, when the moving unit 550 stops at each of the predetermined stop locations P, the columnar-shaped member 559 is attracted by the permanent magnet 901 provided to the pressed part 900.

This presses the columnar-shaped member 559 to the pressed part 900 to perform positioning of the support member 20 in the longitudinal direction of the support member 20. In other words, positioning of the can body 10 in the axial direction of the can body 10 is performed.

To additionally describe, in the exemplary embodiment, a part of the moving unit 550 is biased by a magnetic force toward the side where the pressed part 900 is provided, and thereby the part is pressed against the pressed part 900.

To put it another way, in the exemplary embodiment, the support member 20 supporting the can body 10 is pressed against the pressed part 900 via the columnar-shaped member 559 by the magnetic force.

Consequently, in the exemplary embodiment, the can body 10 is positioned to a predetermined location blow the first inkjet head 11C. More specifically, positioning of the can body 10 in the axial direction of the can body 10 is performed.

Here, the permanent magnet 901 and the like can be grasped as a biasing unit that biases the part to be pressed against the pressed part 900 toward the side where the pressed part 900 is provided.

Note that, in the exemplary embodiment, the permanent magnet 901 was provided to the pressed part 900 side; however, the permanent magnet 901 may be provided to the columnar-shaped member 559 side or may be provided to both the pressed part 900 and the columnar-shaped member 559.

Moreover, the electromagnet, not the permanent magnet 901, may be used.

Moreover, biasing of the columnar-shaped member 559 toward the pressed part 900 may not be limited to the magnetic force, but may be performed by other methods.

For example, biasing of the columnar-shaped member 559 toward the pressed part 900 may be performed by reducing pressure on the side where the pressed part 900 is provided, to thereby attract the part of the moving unit 550.

Moreover, for example, biasing of the columnar-shaped member 559 toward the pressed part 900 may be performed by pressing the moving unit 550 and/or the can body 10 toward the pressed part 900 side.

Further, in the exemplary embodiment, at the stop location P, positioning of the can body 10 in the radial direction is also performed, the can body 10 being held by the moving unit 550. To additionally describe, positioning of the support member 20 in the radial direction of the support member 20 is also performed.

Further, in the exemplary embodiment, at the stop location P, the phase of the can body 10 (the columnar-shaped member 559 and the support member 20) with respect to the pressed part 900 as an example of a rotation body becomes a predetermined phase.

To additionally describe, in the exemplary embodiment, when the columnar-shaped member 559 is pressed against the pressed part 900, the phase of the columnar-shaped member 559 with respect to the pressed part 900 becomes the predetermined phase.

To describe further, in the exemplary embodiment, when the columnar-shaped member 559 is pressed against the pressed part 900, positioning of the columnar-shaped member 559 also being positioning of the pressed part 900 in the rotation direction (the circumferential direction) is performed.

Consequently, in the exemplary embodiment, the phase of the columnar-shaped member 559 with respect to the pressed part 900 becomes a predetermined phase.

To additionally describe, in the exemplary embodiment, when the columnar-shaped member 559 is pressed against the pressed part 900, the phase of the columnar-shaped member 559 with respect to the pressed part 900 does not become any phase other than the single predetermined phase.

In the exemplary embodiment, when the columnar-shaped member 559 is pressed against the pressed part 900, in each of the axial direction of the pressed part 900 and the radial direction of the pressed part 900, the position of the columnar-shaped member 559 is adjusted to perform positioning of the columnar-shaped member 559.

Further, in the exemplary embodiment, the rotation angle of the columnar-shaped member 559 in the circumferential direction of the pressed part 900 is adjusted, and thereby the phase (the rotation angle) of the columnar-shaped member 559 with respect to the pressed part 900 becomes the predetermined single phase (the rotation angle).

In the exemplary embodiment, when the positioning of the columnar-shaped member 559 is performed, the can body 10 comes to be positioned directly below the inkjet head 11C. Moreover, the longitudinal direction of the inkjet head 11C and the axial direction of the can body 10 extend in parallel with each other.

Further, when the positioning of the columnar-shaped member 559 is performed, the can body 10 is disposed at a predetermined location in the longitudinal direction of the inkjet head 11C.

Figure 6A:
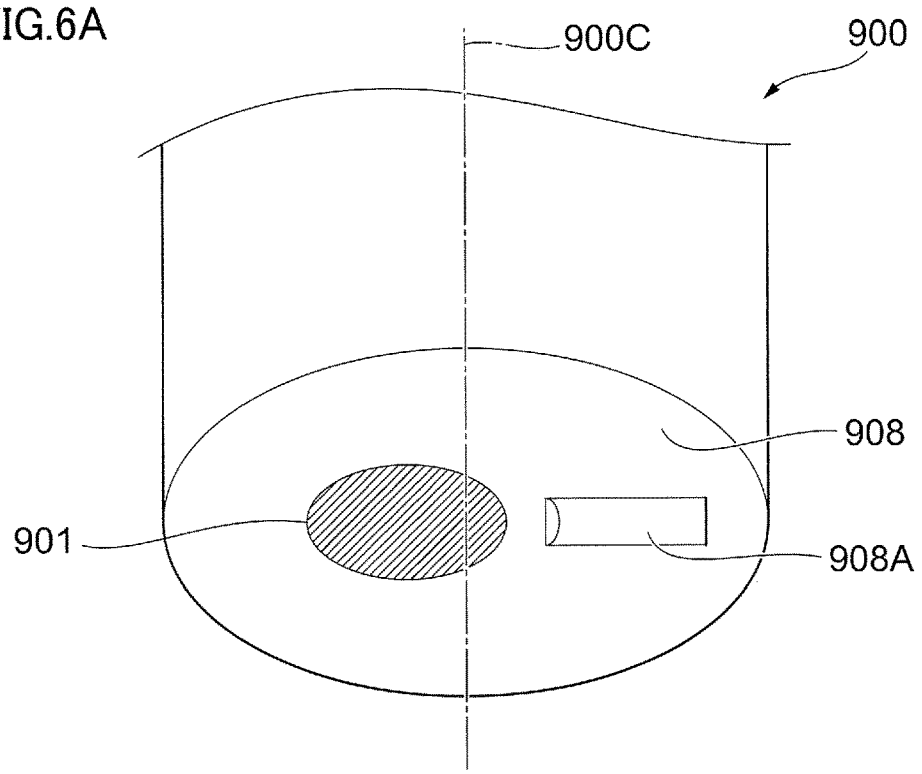
FIGS. 6A and 6B are diagrams illustrating a pressed part and a columnar-shaped member, respectively.
Figure 6B:
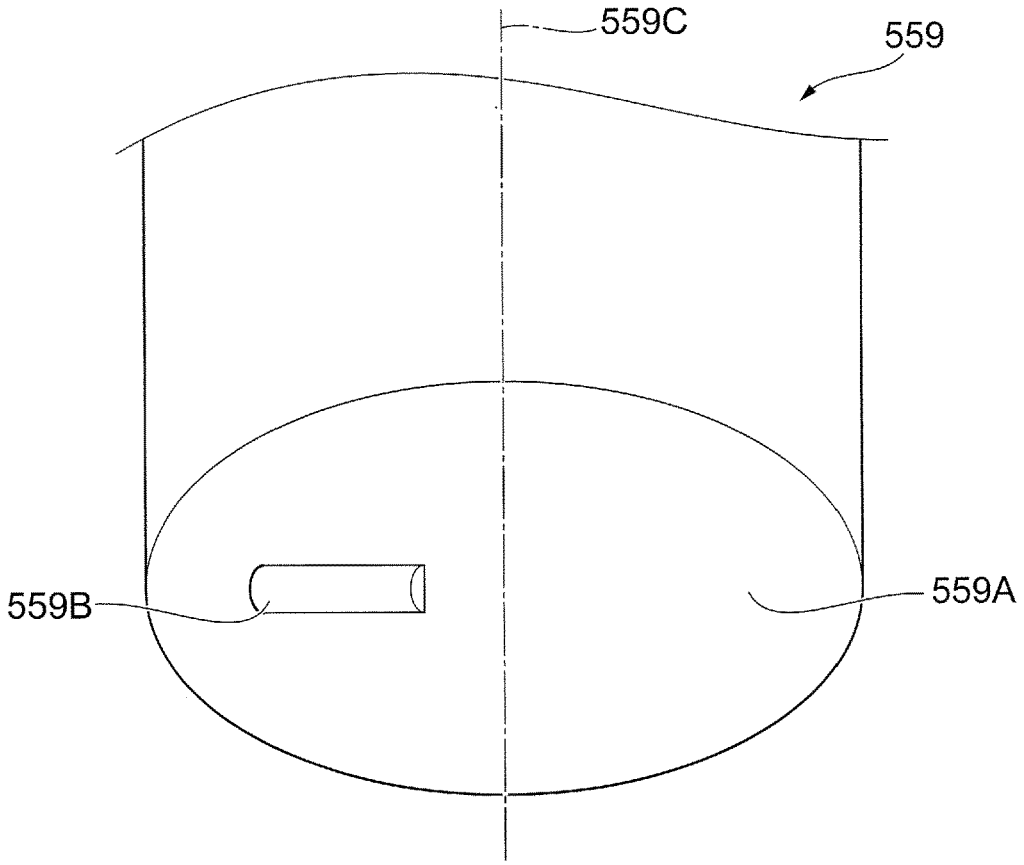

FIGS. 6A and 6B are diagrams illustrating the pressed part 900 and the columnar-shaped member 559, respectively. More specifically, FIG. 6A is a diagram in the case where the pressed part 900 is viewed from the direction of the arrow VIA in FIG. 5, and FIG. 6B is a diagram in the case where the columnar-shaped member 559 is viewed from the direction of the arrow VIB in FIG. 5.

As shown in FIG. 6A, in the exemplary embodiment, a circular facing surface 908 of the pressed part 900 is provided with a concave portion 908A, the facing surface 908 facing the columnar-shaped member 559. Further, on the facing surface 908, the permanent magnet 901 is installed.

Moreover, as shown in FIG. 6B, a facing surface 559A of the columnar-shaped member 559 is provided with a convex portion 559B to be inserted into the concave portion 908A, the facing surface 559A facing the facing surface 908 of the pressed part 900.

The concave portion 908A is positioned at a location deviated from the rotation axis (the rotation center) 900C of the pressed part 900, and is formed to extend along the radial direction of the pressed part 900.

The convex portion 559B is also positioned at a location deviated from the rotation axis 559C of the columnar-shaped member 559. Further, the convex portion 559B is also disposed to extend along the radial direction of the columnar-shaped member 559.

In the exemplary embodiment, when the rotation angle of the columnar-shaped member 559 with respect to the pressed part 900 (the relative rotation angle) reaches a predetermined rotation angle, the convex portion 559B is inserted into the concave portion 908A. Consequently, in the exemplary embodiment, the columnar-shaped member 559 is pressed against the pressed part in the state where the phase of the columnar-shaped member 559 with respect to the pressed part 900 is the predetermined phase.

Then, in this case, the can body 10 supported by the support member 20 also comes to be disposed with the predetermined phase with respect to the pressed part 900.

Here, the pressed part 900 including the concave portion 908A and the columnar-shaped member 559 including the convex portion 559B can be grasped as a phase adjustment unit setting the phase of the can body 10 with respect to the pressed part 900 at the predetermined phase.

Further, in the exemplary embodiment, the convex portion 559B is inserted into the concave portion 908A, to thereby perform positioning of the columnar-shaped member 559 in the radial direction of the pressed part 900. In other words, positioning of the can body 10 in the radial direction of the can body 10 is performed.

Here, the pressed part 900 including the concave portion 908A and the columnar-shaped member 559 including the convex portion 559B can be grasped as a positioning unit performing positioning of the can body 10 in the radial direction of the can body 10.

Further, in the exemplary embodiment, when the convex portion 559B is inserted into the concave portion 908A, the facing surface 908 and the facing surface 559A butt against each other. Consequently, in the exemplary embodiment, positioning of the can body 10 in the axial direction of the can body 10 is also performed.

Figure 7A:
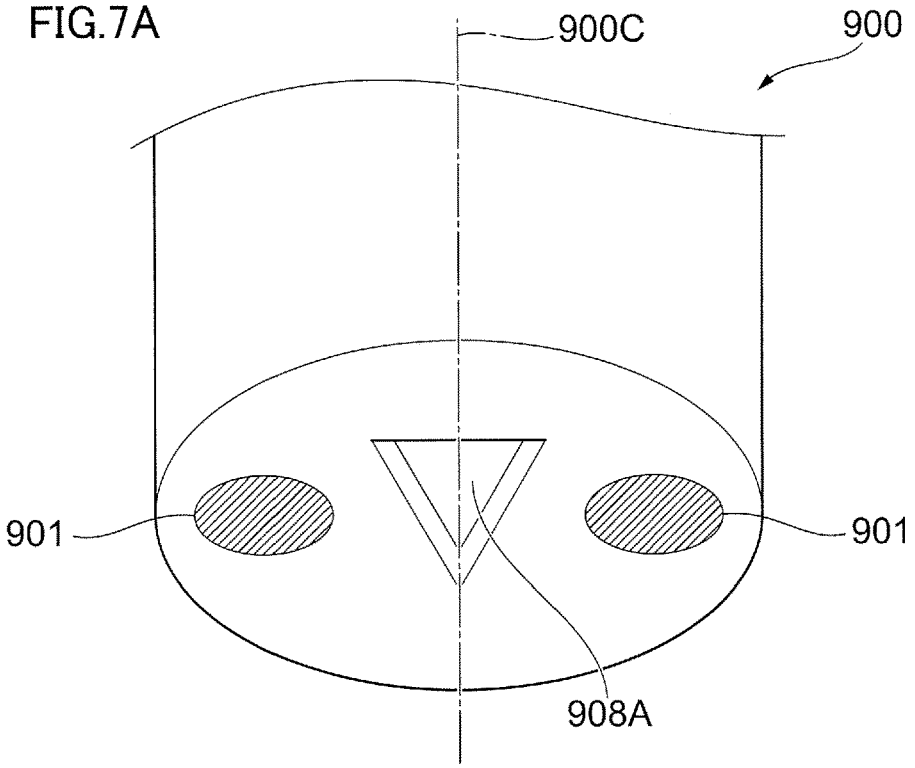
FIGS. 7A and 7B are diagrams showing another configuration example of the pressed part and the columnar-shaped member, respectively.
Figure 7B:
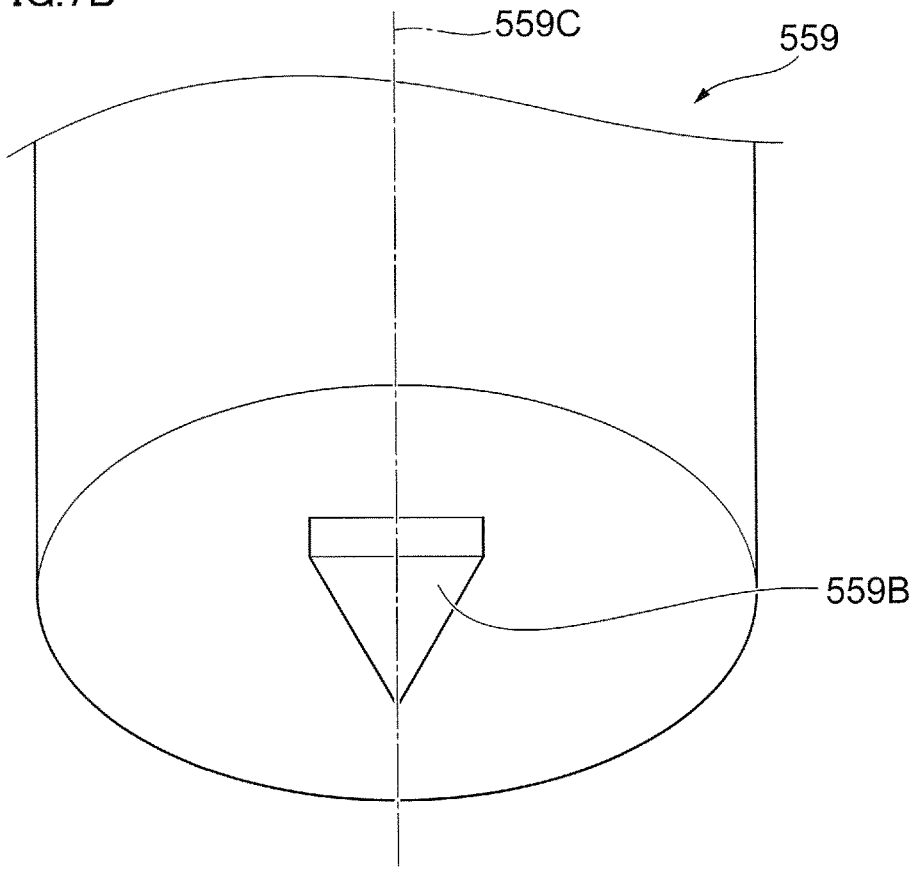

Note that, as shown in FIGS. 7A and 7B (the diagrams showing another configuration example of the pressed part 900 and the columnar-shaped member 559, respectively), the concave portion 908A and the convex portion 559B may be provided on the rotation axes included in the pressed part 900 and the columnar-shaped member 559, respectively (the rotation axis 900C and the rotation axis 559C).

In the configuration example, the shape of the convex portion 559B and the concave portion 908A viewed from the front is an isosceles triangle. In the configuration example, similar to the above, when the rotation angle of the columnar-shaped member 559 with respect to the pressed part 900 reaches a predetermined rotation angle, the convex portion 559B is also inserted into the concave portion 908A.

Then, when the convex portion 559B is inserted into the concave portion 908A, similar to the above, positioning of the can body 10 in the radial direction of the can body 10 and positioning of the can body 10 in the axial direction of the can body 10 are performed.

Further, the phase of the can body 10 with respect to the pressed part 900 becomes a predetermined phase.

Note that, in the exemplary embodiment, when the above-described positioning of the can body 10 (the columnar-shaped member 559) is performed, the columnar-shaped member 559 is caused to approach the pressed part 900 by use of the magnetic force in the state of rotating the pressed part 900.

Then, the convex portion 559B and the concave portion 908A are brought into the state of facing each other, the convex portion 559B is inserted into the concave portion 908A, to thereby perform the above-described positioning.

Thereafter (after the positioning), in the exemplary embodiment, ink ejection from the inkjet head 11C is performed in the state where the pressed part 900 is rotated at a predetermined number of rotations. Consequently, an image is formed on the outer circumferential surface of the can body 10.

In the exemplary embodiment, the pressed part 900 is disposed coaxially with the columnar-shaped member 559 that is rotated by the pressed part 900, and thereby the columnar-shaped member 559 is also rotated when the pressed part 900 is rotated. Consequently, the can body 10 rotates in the circumferential direction.

To additionally describe, in the exemplary embodiment, the rotational driving force from the servomotor M is transmitted to the moving unit 550 side via the pressed part 900 and the columnar-shaped member 559, and therefore, the can body 10 in the moving unit 550 rotates in the circumferential direction.

To describe further, in the exemplary embodiment, the pressed part 900 is disposed coaxially with the can body 10 held by the moving unit 550 stopped at the stop location P.

Then, in the exemplary embodiment, when the pressed part 900 is rotated, the rotational driving force from the pressed part 900 is transmitted to the can body 10 via the columnar-shaped member 559 and the support member 20, and thereby the can body 10 rotates in the circumferential direction.

To describe further, as shown in FIG. 5, the pressed part 900 of the exemplary embodiment is disposed coaxially with the can body 10, and further, disposed on the opening portion 10A side included in the can body 10.

Then, in the exemplary embodiment, when the pressed part 900 is rotated, the support member 20 inserted into the can body 10 through the opening portion 10A is rotated; with this, the can body 10 rotates in the circumferential direction.

Figure 8A:
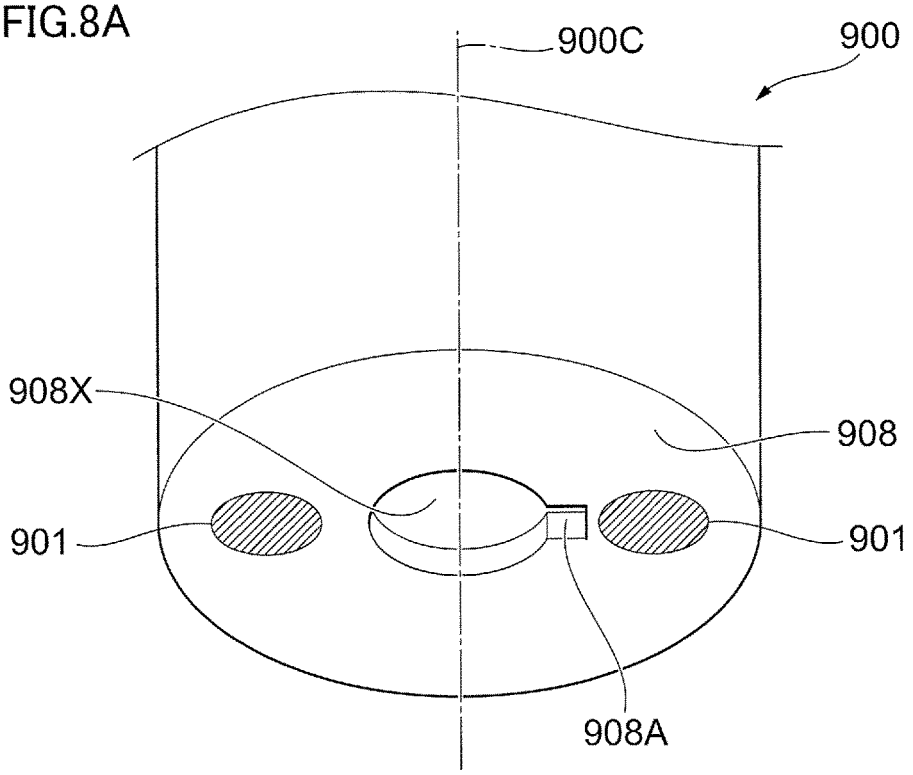
FIGS. 8A and 8B are diagrams showing still another configuration example of the pressed part and the columnar-shaped member, respectively.
Figure 8B:
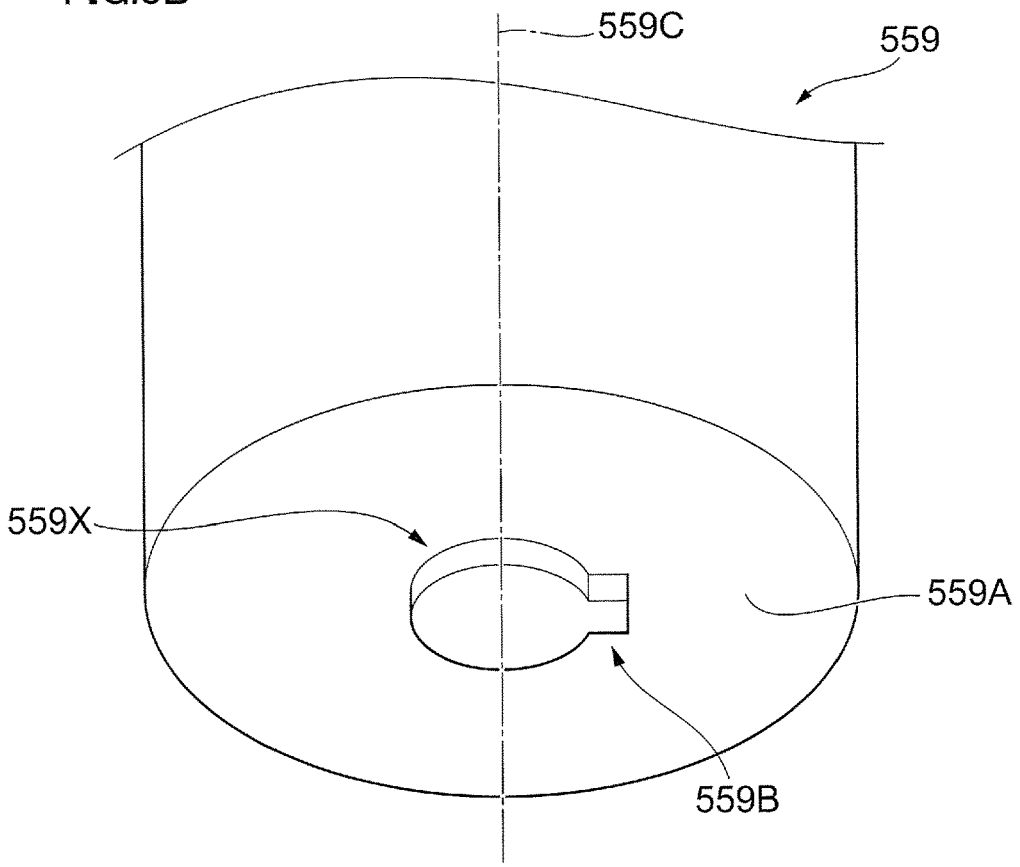

FIGS. 8A and 8B are diagrams showing still another configuration example of the pressed part 900 and the columnar-shaped member 559, respectively.

In the configuration example, as shown in FIGS. 8A and 8B, there are provided a convex portion 559B projecting in the radial direction of the columnar-shaped member 559 and a concave portion 908A recessed in the radial direction of the pressed part 900.

More specifically, in the configuration example shown in FIGS. 8A and 8B, a columnar-shaped projecting portion 559X projecting in the axial direction from the facing surface 559A of the columnar-shaped member 559 is provided, and the convex portion 559B is projecting from the outer circumferential surface of the projecting part 559X.

Moreover, regarding the pressed part 900 side, a concave portion 908X having a circular cross section and recessed in the axial direction of the pressed part 900 is provided, and the concave portion 908A is provided on the inner circumferential surface of the concave portion 908X.

In the configuration example, similar to the above, the facing surface 908 of the pressed part 900 and the facing surface 559A of the columnar-shaped member 559 butt against each other, and thereby positioning of the can body 10 in the axial direction of the can body 10 is performed.

Moreover, the columnar-shaped projecting portion 559X of the columnar-shaped member 559 is inserted into the circular concave portion 908X of the pressed part 900, and thereby positioning of the can body 10 in the radial direction of the can body 10 is performed.

In addition, the convex portion 559B of the columnar-shaped member 559 is inserted into the concave portion 908A of the pressed part 900, and thereby the phase of the can body 10 with respect to the pressed part 900 becomes a single predetermined phase.

Note that, in the above, the concave portions, such as the concave portion 908A and the concave portion 908X, were provided on the pressed part 900 side, and the convex portions, such as the convex portion 559B and the projecting portion 559X, were provided on the columnar-shaped member 559 side; however, it may be possible to provide the convex portions on the pressed part 900 side and the concave portions on the columnar-shaped member 559 side.

With reference to FIG. 5 again, a retracting mechanism 789 will be described.

In the exemplary embodiment, as shown in FIG. 5, a retracting mechanism 789 retracting the columnar-shaped member 559 from the pressed part 900 is provided.

When the processing at the stop location P is completed, in accordance with a signal from the control part, the retracting mechanism 789 is driven. Consequently, the columnar-shaped member 559 is retracted from the pressed part 900, and thereby the columnar-shaped member 559 is separated from the pressed part 900. Thus, further movement of the moving unit 550 on the downstream side becomes possible.

The retracting mechanism 789 is provided with a moving 781 moving along the axial direction of the pressed part 900 to press the columnar-shaped member 559. Moreover, there is provided a moving mechanism (not shown) causing the moving member 781 to move toward the columnar-shaped member 559.

Note that the moving mechanism is configured by use of a known mechanism. Specifically, the moving mechanism is provided with a driving source, such as a motor, an air cylinder and a solenoid, and by using the driving force generated in the driving source, the moving member 781 is moved.

In the printing apparatus 500 of the exemplary embodiment, the attitudes of the moving units 550 when the moving units 550 are stopped are likely to differ by each of the moving units 550.

In particular, as in the exemplary embodiment, with the configuration in which the moving units 550 individually move, the attitudes of the moving units 550 are likely to differ. In this case, quality of the image formed on the can body 10 can hardly be stable.

In contrast thereto, in the configuration of the exemplary embodiment, each of the moving units 550 is pressed against the pressed part 900, which is a common member, and therefore, differences in attitudes of the moving units 550 on a one-by-one basis are less likely to occur.

This makes the quality of the image to be formed on each of the can bodies 10 stable.

Moreover, in the exemplary embodiment, the moving unit 550 is not provided with a motor for rotating the columnar-shaped member 559 (the can body 10); the columnar-shaped member 559 is rotated by the servomotor M provided to the main body side of the printing apparatus 500.

Consequently, the moving unit 550 can be made light, and therefore, vibrations of the printing apparatus 500 caused by movement of the moving units 500 are reduced.

Here, if the moving unit 550 is provided with the motor for rotating the can body 10 and thereby the moving unit 550 has a large weight, vibrations of the printing apparatus 500 when the moving units 550 are stopped are likely to be increased. Then, in this case, the inkjet heads 11 and the like vibrate, to thereby lead to degradation of image quality.

In contrast thereto, as in the exemplary embodiment, in the configuration in which the motor is provided to the main body side of the printing apparatus 500, the moving unit 550 is made lighter in weight, and thereby vibrations of the printing apparatus 500 when the moving units 550 are stopped are reduced.

Moreover, in the exemplary embodiment, in each of the inkjet heads 11 and the like, printing may be started when the rotation angle of the servomotor M reaches a predetermined angle; therefore, registration of images formed by respective colors can be performed easier.

More specifically, in the exemplary embodiment, as described above, the can body 10 is disposed in the state where the rotation angle of the can body 10 with respect to the pressed part 900 reaches the single predetermined angle at each of the stop locations P.

For this reason, when the rotation angle (the phase) of the pressed part 900 is the predetermined rotation angle (when the rotation angle of the servomotor M is the predetermined rotation angle), the can body 10, which is a printing target, is also disposed at the predetermined rotation angle.

Then, in this case, as described above, if the printing is started when the rotation angle of the servomotor M reaches the predetermined angle, registration of images formed by respective colors is naturally performed.

Figure 9:
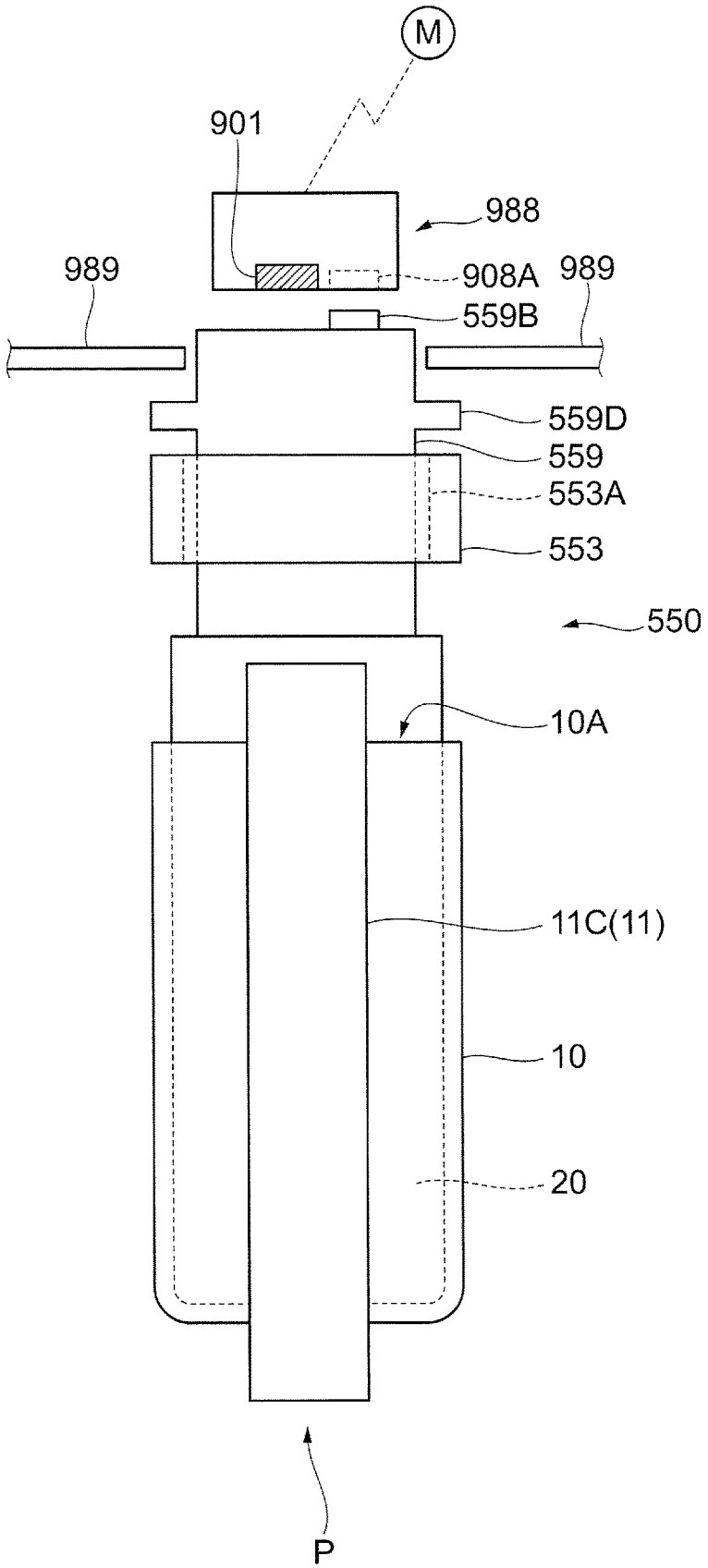

FIG. 9 is a diagram showing another configuration example of the columnar-shaped member 559 and the like. Note that, with regard to the members having functions similar to those in the above, same reference signs are given and detailed descriptions thereof will be omitted.

In the configuration example shown in FIG. 9, there is provided a rotation member 988 including the permanent magnet 901 and the concave portion 908A. The rotation member 988 is, similar to the above, rotated by the servomotor M. In the configuration example, the rotation member 988 attracts the columnar-shaped member 559 having the convex portion 559B.

Moreover, in the configuration example, a positioning member 989 functioning as the pressed part is provided closer to the columnar-shaped member 559 side than the rotation member 988. In the exemplary embodiment, a part of the columnar-shaped member 559 attracted by the rotation member 988 is pressed against the positioning member 989.

More specifically, an annular-shaped projecting portion 559D is provided on the outer circumferential surface of the columnar-shaped member 559, and the projecting portion 559D is pressed against the positioning member 989.

In the configuration example, similar to the above, the positioning of the columnar-shaped member 559 in the radial direction of the columnar-shaped member 559 and the positioning of the columnar-shaped member 559 in the circumferential direction of the columnar-shaped member 559 are performed by the concave portion 908A provided to the rotation member 988 and the convex portion 559B provided to the columnar-shaped member 559.

In addition, in the configuration example, the positioning of the columnar-shaped member 559 in the axial direction thereof is performed by butting of the projecting portion 559D of the columnar-shaped member 559 against the positioning member 989.

Note that, in the above, description was given of the case where the columnar-shaped member 559 was biased in the axial direction of the can body 10; however, the columnar-shaped member 559 and the support member 20 may be biased in the radial direction of the can body 10 to press these members against the pressed part 900.

Moreover, in the above, description was given of the case where a part of the moving unit 550 was pressed against the pressed part 900; however, a part of the can body 10 may be pressed against the pressed part 900. Moreover, both the moving unit 550 and the can body 10 may be pressed against the pressed part 900.

Further, in the above, a part of the moving unit 550 is moved with respect to the pressed part 900 in the static state; however, it may be possible to provide a movable pressing part and press the pressing part against the moving unit 550 and/or the can body 10, to thereby perform positioning of the can body 10.

Figure 10:
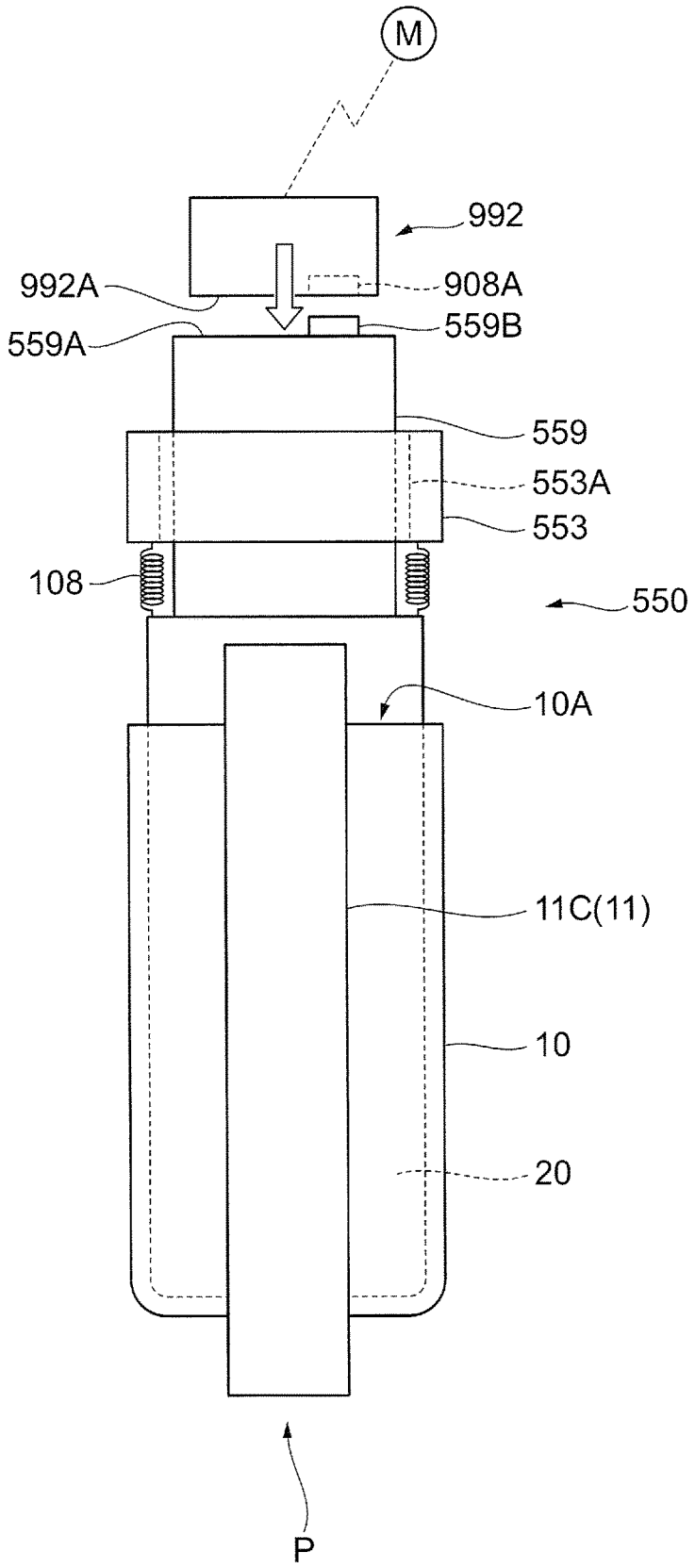
FIG. 10 is a diagram showing a configuration example in which a pressing part is moved and the pressing part is pressed against the moving unit.

FIG. 10 is a diagram showing a configuration example in which a pressing part 992 is moved and the pressing part 992 is pressed against the moving unit 550. Note that, with regard to the portions having functions similar to those in the above, same reference signs are given.

In the configuration example, for example, after the moving unit 550 is stopped below the inkjet heads 11, the pressing part 992 in the rotating state is forwarded toward the columnar-shaped member 559.

More specifically, the pressing part 992 in the state of keeping a predetermined attitude is forwarded toward the columnar-shaped member 559. Then, a forwarding amount of the pressing part 992 reaches a predetermined forwarding amount, the pressing part 992 is stopped.

Consequently, in this case, the columnar-shaped member 559 is also brought into the state of being pressed against the pressing part 992; in this case, similar to the above, positioning of the can body 10 is also performed.

More specifically, in the configuration example, the moving unit 550 is provided with a biasing member 108, such as a spring member, and therefore, the columnar-shaped member 559 is biased toward the pressing part 992.

When the pressing part 992 is forwarded toward the columnar-shaped member 559, the columnar-shaped member 559 is biased toward the pressing part 992 by the biasing member 108.

When the columnar-shaped member 559 is brought into contact with the pressing part 992, also in the configuration example, the convex portion 559B of the columnar-shaped member 559 is inserted into the concave portion 908A of the pressing part 992. In addition, the facing surface 992A of the pressed part 992 and the facing surface 559A of the columnar-shaped member 559 butt against each other.

Consequently, in the configuration example, similar to the above, the positioning of the can body 10 in the axial direction thereof, the positioning of the can body 10 in the radial direction thereof and the positioning of the can body 10 in the circumferential direction thereof are also performed.

OTHERS

In the above, the moving unit 550 is moved by using a so-called linear motor, but movement of the moving unit 550 is not limited to the linear motor; for example, the movement may be performed by attaching the moving unit 550 to an endless member (a member such as a belt) and orbitally moving the endless member.

Moreover, for example, it may be possible to provide a driving source, such as a motor, for moving the moving unit 550 to each of the moving units 550, to thereby move the moving unit 550 autonomously.

Moreover, in the above, description was given to the case in which the pressed part 900 or the pressing part 992 was provided to the inkjet printing part 700; however, the pressed part 900 or the pressing part 992 is also provided to parts other than the inkjet printing part 700.

Specifically, the pressed part 900 or the pressing part 992 is also provided to the can body supply part 510, the light irradiation part 750, the plate printing part 760, the protection layer forming part 770 and the like.

Then, in each of the can body supply part 510, the light irradiation part 750, the plate printing part 760 and the protection layer forming part 770, similar to the above, positioning of the can body 10 is performed, and the driving force is supplied from the pressed part 900 or the pressing part 992 to the can body 10.

The invention claimed is:

1. A printing apparatus comprising:

a moving body moving while holding a can body;

an image forming unit forming an image onto the can body on the moving body stopped at a predetermined stop location;

a pressed part installed at the stop location where the image is formed, at least one of a portion of the moving body stopped at the stop location and a portion of the can body held by the moving body being pressed against the pressed part; and a biasing unit biasing at least the portion toward a side where the pressed part is provided, wherein, when the image is formed by the image forming unit, the portion is pressed against the pressed part by the biasing unit in a state where the can body is held by the moving body.

2. The printing apparatus according to claim 1, wherein the biasing unit biases the portion toward the side where the pressed part is provided by use of a magnetic force.

3. The printing apparatus according to claim 1, wherein the pressed part rotates and a driving force rotating the can body is transmitted to the moving body via the pressed part and the portion.

4. The printing apparatus according to claim 1, wherein the pressed part is disposed coaxially with the can body held by the moving body stopped at the stop location.

5. The printing apparatus according to claim 4, wherein the pressed part is disposed coaxially with the can body, the pressed part is disposed coaxially with the can body, the pressed part also being disposed on an opening side included in the can body.

6. The printing apparatus according to claim 1, further comprising:

a positioning unit provided to the stop location, the positioning unit performing positioning of the can body, which is held by the moving body, in a radial direction.

7. The printing apparatus according to claim 1, further comprising:

a rotation body provided to the stop location, the rotation body being disposed coaxially with the can body held by the moving body stopped at the stop location to be used for rotating the can body; and a phase adjustment unit provided to the stop location, the phase adjustment unit adjusting a phase of the can body held by the moving body stopped at the stop location with respect to the rotation body to a predetermined phase.

8. The printing apparatus according to claim 7, wherein the phase adjustment unit adjusts a phase of the can body with respect to the rotation body to one predetermined phase.

9. The printing apparatus according to claim 1, wherein the moving body is not provided with a motor used to rotate the can body held by the moving body.

10. A printing apparatus comprising:

a moving body moving while holding a can body;

an image forming unit forming an image on the can body on the moving body stopped at a predetermined stop location; and a pressing part installed at the stop location where the image is formed, the pressing part being pressed against at least one of a portion of the moving body stopped at the stop location and a portion of the can body held by the moving body, wherein the pressing part is pressed against the portion in a state where the can body is held by the moving body.

* * * * *